United States Patent [19]

Watkins

[11] 4,193,856

[45] Mar. 18, 1980

[54] USE OF ELECTROFILTER AS AN EXTRACTION COLUMN

[75] Inventor: Leslie R. Watkins, Houston, Tex.

[73] Assignee: Petrolite Corporation, St. Louis, Mo.

[21] Appl. No.: 809,745

[22] Filed: Jun. 24, 1977

[51] Int. Cl.[2] ..... B03C 5/00

[52] U.S. Cl. ..... 204/186; 210/21; 260/412.4; 426/430

[58] Field of Search ..... 210/21, 22, 511, 67, 210/198 R; 426/430; 204/186, 180 R, 184, 188–191, 302, 308, 167; 260/412.2, 412.4, 428.5; 23/270 B, 270 R, 272, 272.6 T

[56] References Cited

U.S. PATENT DOCUMENTS

| | | | |
|---|---|---|---|
| 1,326,968 | 1/1920 | Rogers | 204/131 |
| 2,534,904 | 12/1950 | Ham et al. | 204/188 |
| 3,365,440 | 1/1968 | Circle et al. | 426/430 X |
| 3,799,856 | 3/1974 | Franse | 204/188 |
| 3,928,158 | 12/1975 | Fritsche | 204/302 |
| 4,040,926 | 8/1977 | Oberton | 204/186 |
| 4,049,520 | 9/1977 | Wagner | 204/186 |

OTHER PUBLICATIONS

Swern, "Bailey's Industrial Oil and Fat Products", 3rd edition, John Wiley and Sons, N. Y., 1964, p. 886.

Haines et al., "Industrial and Engineering Chemistry", vol. 49, pp. 920–929 (1957).

Vix et al., "Chemical Engineering Progress Symposium Series", vol. 65, No. 93 (1969), pp. 49–56.

*Primary Examiner*—Frank A. Spear, Jr.

*Attorney, Agent, or Firm*—Sidney B. Ring; Hyman F. Glass

[57] ABSTRACT

The use of an electrofilter as an extraction column and/or as an extraction column-filter combination is disclosed. Solvent-extractible solids positioned in an electrically activated electrofilter are subjected to solvent extraction. The solids positioned in the electrically activated electrofilter may be previously unextracted, partially extracted or completely extracted, or combinations thereof. When the process is completed, the solid material can be removed from the electrofilter by electrically deactivating the electrofilter and removing the solids therefrom by any suitable means, such as by means of a solvent wash. The process may be efficiently utilized for oilseed extraction.

19 Claims, 1 Drawing Figure

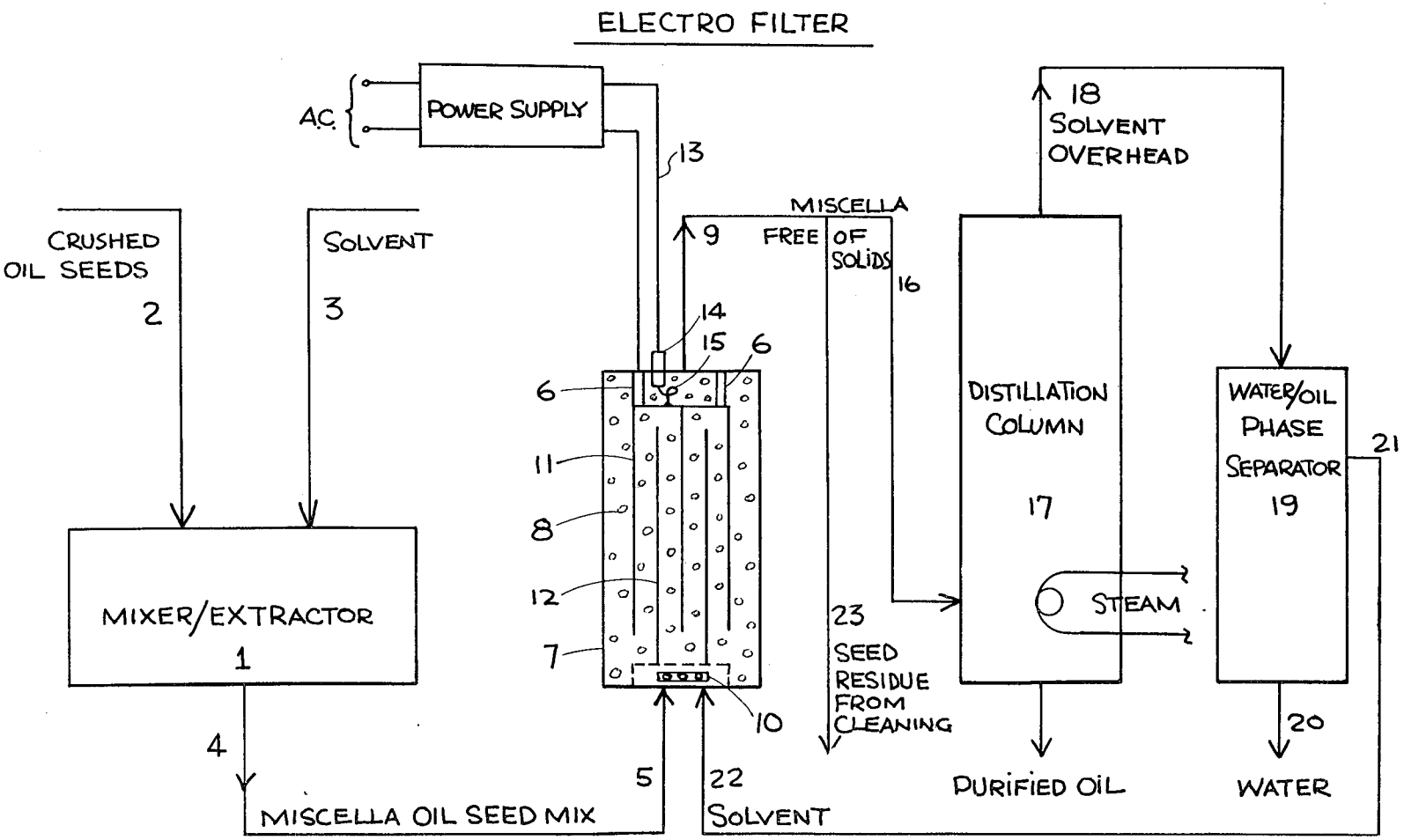
ELECTRO FILTER
POWER SUPPLY
A.C.
13
14
15
6
9
MISCELLA FREE OF SOLIDS
16
DISTILLATION COLUMN
17
18 SOLVENT OVERHEAD
STEAM
WATER/OIL PHASE SEPARATOR
19
21
20
WATER
PURIFIED OIL
23
SEED RESIDUE FROM CLEANING
10
22
SOLVENT
5
MISCELLA OIL SEED MIX
11
8
12
7
SOLVENT
3
CRUSHED OIL SEEDS
2
MIXER/EXTRACTOR
1
4

USE OF ELECTROFILTER AS AN EXTRACTION COLUMN

BACKGROUND OF THE INVENTION

For as long as recorded history, man has recovered oil from crushed oilseeds by a variety of steps. In particular, the oil recovered from seeds such as various beans, palm oil, peanuts, etc., has formed an important portion of the food supply for people. In addition, man has long extracted oils from other types of seeds, such as linseed, flaxseed, and the like, for use in various products such as paints, medicinal products, and so forth. In most cases, the proper oilseeds are prepared by various mechanical and chemical processes so that the greatest possible amount of oil can be recovered. Generally, the oilseeds are prepared by crushing which includes rolling, grinding, or other means to reduce the seeds to a commuted form of relatively small particles. The crushed seeds are usually given a heat treatment. Then, the oil is recovered from the hot seed material by either mechanical means, such as pressing, or through the use of solvents by extraction processes, or a combination of both procedures.

Whatever the nature of the oilseeds and the oil to be recovered, it has been long appreciated that the mechanical action taken upon the seeds in the crushing operation produces finely divided solid material which contains a substantial amount of fibrous material. For example, in the conventional pressing of crushed and heated cottonseed, the oil may contain several percent of finely divided solid material. Unfortunately, this solid material also contains an appreciable portion of fibrous material. The same situation exists nearly universally in the solvent extraction processes employing a liquid solvent (e.g., hexane). In either instance, the solid material has to be removed from the recovered oil before subsequent processing.

An application of Oliver Wagner, Ser. No. 759,155, filed Jan. 13, 1977, employs a novel combination of steps in conjunction with the use of solvent recovery for oil extracted from crushed oilseeds in such a step arrangement that relatively inexpensive equipment and processing steps produce a purified oil that is substantially free of all finely divided solid material, a miscella (i.e., extracted oil plus solvent) that can be distilled to produce a pure solvent free of solids and a purified oil without requiring successive states of mechanical filtration, centrifuges, and high costs in ancillary material such as filteraid and operator time.

In accordance with said Ser. No. 759,155, there is provided a process for purifying oil removed from crushed oilseeds. The process has the steps of extracting the crushed oilseeds with a liquid dielectric solvent forming a miscella carrying finely divided solid material with a substantial content of fibrous material. The extraction consists of first contacting the crushed oil seeds with the solvent and then separating the resulting miscella from the oil seed residue. The miscella is subjected to electrofiltration by passage through a bed of dielectric particulate solids interposed within a d.c. electric field having a gradient of at least 20 kilovolts per inch whereby the finely divided solid material in substantial totality adheres to the particulate solids in the bed and provides a purified miscella that is substantially free of finely divided solid material. The purified miscella is rectified into a purified oil free of finely divided solid material and the dielectric solvent. The purified oil is passed to a subsequent utilization. The electric field in the bed of particulare solids is periodically interrupted and then, a dielectric fluid is circulated therethrough to remove the priorly adhering finely divided solid material.

SUMMARY OF THE INVENTION

I have now discovered that an electrofilter can be used as an extraction column and/or as an extraction column-filter combination. More particularly, I have discovered a process of solvent extracting solvent-extractible solids positioned in an electrically activated electrofilter. The solid material positioned in the electrically activated electrofilter may be previously unextracted, partially extracted or completely extracted, or combinations thereof. When the process is completed, the solid material can be removed from the electrofilter by electrically deactivating the electrofilter and removing the solids therefrom by any suitable means, such as by means of a solvent wash. As a specific embodiment, this invention relates to the use of an electrofilter as an extraction column and/or as an extraction column-filter combination in oilseed extraction systems.

I have discovered that oil can be efficiently extracted from oilseeds by positioning crushed oilseeds in an electrically activated electrofilter and contacting the oilseeds with a dielectric solvent so as to extract the oil therefrom. Periodically, the electrofilter is electrically deactivated so that the crushed oilseeds are removed by any suitable means such as by solvent flow.

The solvent extraction of oilseeds includes the steps of:

(1) Loading the bed of an electrically activated electrofilter with oilseeds from a miscella mix, (2) Flushing the loaded bed with a dielectric solvent for the oil so as to remove the miscella and oil, thus leaving solid material adhering to the bed of the electrofilter, (3) Removing deoiled solids from the electrically deactivated electrofilter bed by flushing with solvent, (4) Reloading the bed of the electrically activated electrofilter with oilseeds from a miscella and repeat process.

The miscella can be prepared in any conventional manner and extraction of the oil from the seeds can be carried out to any desirable degree of extraction—little, incomplete, or substantially complete extraction—before adding to the electrofilter. Thus, the electrofilter can act as an electrofilter removing substantially all of the solids (including the fines and other materials which are usually a problem in the extracted oil), as an extraction column, and/or as a combination extraction column-electrofilter.

By employing this system instead of the conventional miscella system one obtains (1) a simple and efficient extraction column, (2) a simple and efficient method of removing solids, (3) a method of substantially eliminating oilseeds, fines and other materials which are present in oil extracted by conventional methods.

In contrast to said Ser. No. 759,155 where the miscella, which is already separated from the crushed oilseeds, is freed of finely divided solids by electrofiltration, the present process employs the electrofilter as a combination extraction/electrofilter column for the miscella crushed seeds mix. Stated another way, whereas Ser. No. 759,155 separates carry-over solids from the miscella (from which the crushed seeds have been separated) the present process separates all solids, including the crushed seeds, by electrofiltration. In addition the electrofilter can act as an extraction column.

DESCRIPTION OF THE DRAWING

The drawing is a diagrammatic illustration, in flow schematic, of an arrangement of apparatus for carrying out the novel steps of the present process.

DETAILED DESCRIPTION OF THE INVENTION

The present process will be described in the purification of one type of oil extracted from crushed oilseeds, namely, soybeans, which probably provide the largest volume of oil recovered in such a manner within the United States. However, it will be appreciated that this process is equally applicable in its utility with other oils such as those recovered from corn, cottonseed, and so forth. There is shown in the drawing an arrangement of apparatus for practicing the steps involved in the present process. However, other arrangements of apparatus which are capable of carrying out the listed steps by direct or equivalent functions can be employed with equal effect in achieving the results of the present process.

In one arrangement, the steps are practiced in an extractor/mixer 1, an electrofilter, a distillation tower or column 17, a phase separator 19, and the usual arrangement of interconnecting conduits for conveying flow between these elements. As will be apparent, other equivalent equipment can be substituted or interposed within the flow conduits associated with the apparatus shown in the drawing.

The extractor/mixer 1 is conventional and operates on a continuous or discontinuous basis. Generally, the extractor/mixer 1 receives a charge of crushed oilseeds through an inlet 2. A quantity of suitable solvent enters through another inlet 3 into the extractor/mixer 1 in which intimate mixing and contact between seeds and solvent occur for the desired period of time for extraction of the oil from the crushed oilseed to form miscella. The extractor/mixer 1 has an outlet 4 through which the miscella-seed mix is removed.

The miscella-seed mix from the outlet 4 of the extractor/mixer 1 is passed into an inlet 5 of the electrofilter. The miscella-seed mix reaching the electrofilter contains in addition to the seeds a substantial quantity of finely divided solid material (e.g., about 2% by weight) and a substantial portion thereof, (e.g., about 50% by weight of said 2%) is comprised of a fibrous material, resembling the husk of coconuts and the like, formed during crushing of the oilseeds. Thus, the miscella carries finely divided solid material of the character recognized in the prior art as being most difficult to remove by conventional means, such as centifuging, mechanical filtration, water hydration, and like techniques.

The electrofilter is a metal pressure vessel 7 containing a porous bed of dielectric particulate solids 8 disposed in an intense d.c. electric field so that the solid material in the oil are removed in substantial totality by their induced adherence to the particulate solids. The electrofilter can be of commercial design sold in the marketplace under the designation Petreco® Electrofilter TM Separator. The electrofilter has an inlet 5 and an outlet 9. The miscella oilseed mix flows from the inlet 5 into a distributor 10 provided by pipe crossarms containing metering openings. The interior of the vessel contains a plurality of energized electrodes 11 in spaced relationship to a plurality of internested grounded electrodes 12. Preferably, the electrodes 11 and 12 are vertically elongated metal tubes that have substantial overlapping dimensions defining an electric field within the particulate solids 8. The electrodes 11 are suspended from the vessel by insulators 6. In addition the electrodes 11 are energized by an external power supply having a connection to an a.c. power source and providing a high intensity potential through a conductor 13, an entrance bushing 14 and a flexible lead 15 to the electrodes 11. The power supply can be grounded to the vessel by the conductor so that the vessel 7 provides an additional grounded electrode.

The d.c. electric field induces the tenacious adhesion of the finely divided solid material upon the particulate solids 8. The power supply should provide a sufficient intensity d.c. electric field within the particulate solids 8 contained within the electric field defined by the electrodes 11 and 12. Preferably, the electric field produces a potential gradient in the particulate solids 8 of not less than about 20 kilovolts per inch. A certain type of particulate solids should be employed for optimum results. Preferably, the solids 8 are composed of a rigid solid material having a relatively low dielectric constant (e.g., below about 6 at 1 kilohertz). More particularly, the particulate solid is chemically inert, incompressible, hard granular and rigid in nature. The particulate solids can be a solid mineral containing crystalling silicon dioxide, such as flint, garnet, granite and fused quartz. Preferably, the mineral is crushed to provide non-spheroidal configurations which have relatively discontinuous surfaces. For example, crushed flint rock having particle sizes with minimum dimensions between one-eighth and one-half inch are employed to good advantage in the present process. Particulate glass, including glass beads, can also be employed.

The electrofilter produces, for practical purposes, the substantially complete removal of the seeds and other finely divided solid material, and especially the fibrous matter carried therewith, from the miscella. In addition, the electrofilter also removes small amounts of entrained water. It appears also that phosphatides, carbohydrates, and other non-glyceride extractives in some instances are removed concurrently with the finely solid material. The resultant improvement in color and subsequent low refining losses indicate that the electrofilter does produce this removal of additional materials besides the solids.

The operation of the electrofilter in the removal of oilseeds and the finely divided solid material bears no resemblance to problem usage of mechanical filtration requiring large dosages of filteraid material. No filteraid material is required for electrofiltration, and no evidence is present to indicate that the large fibrous material content in the finely divided solid material in any way effects deleteriously the electrofilter.

The purified miscella flows from the electrofilter through the outlet into a rectifying conduit 16 to Distillation column 17. The column 17 has a suitable heat source, such as a steam heating coil, for the distillation separation of the miscella into solvent and oil phases. The miscella is separated in column 17 into a solvent overhead stream removed in an overhead 18 outlet and the purified oil in an underflow outlet. The purified oil removed from the column 17 in the overhead outlet 18 is substantially free of all solid material, water, and purified at least to some extent by removal of some solid-like materials of organic origin. The solvent overhead is passed into a separator 19 which may be of the conventional gravity type. In the separator 19, the solvent overhead is divided into an underflow of water in an outlet 20 and a purified solvent stream in an overhead outlet 21. For practical purposes, the solvent in the outlet 21 is substantially as pure as the original charge of solvent employed in the process. This solvent from the outlet 21 is sent to the inlet 22 of the extractor and/or electrofilter. As a result, a complete cycle of the solvent through the extractor/mixer 1, the electrofilter, the column 17 and separator 19 is possible.

In the present process, the solvent will usually be a hydrocarbon, but other dielectric liquids may be also employed. In particular, the solvent should be a material with a low dielectric constant, e.g., below about 8 to 1 kilohertz. In addition, the solvent as an organic fluid should have a specific resistivity not less than about 50,000 ohm.centimeter. Solvents of this nature function well both in the extractor/mixer 1 and the electrofilter. For example, the liquid dielectric solvent can be selected from the group consisting of hexane, acetone, cyclohexane, like aliphatic hydrocarbons in the boiling range of 88° F. to 264° F., and mixtures thereof. The preferred dielectric solvent is hexane. The use of the hydrocarbon solvent, such as hexane, also permits the removal at least to some extent of solid-like organic materials insoluble in the miscella. This advantage of removing solid material of organic origin is particularly important in that expensive processing steps in the final treatment of the purified oil can be avoided partially or totally.

Eventually the electrofilter removes such large amounts of oilseeds and other finely divided solid material from the miscella that the electric field is no longer adequate to produce the purified miscella desired as the feedstock for column 17. At this time, or some selected time period or by throughput volume, the electrofilter is cleaned and restored to original operating efficiency. For this purpose, the power supply is deactivated to terminate the d.c. electric field within the electrofilter. Then, a dielectric fluid is circulated through the particulate solids 8 to remove the adhering finely divided solid material. Stated in another manner, without the electric field being present, the circulating dielectric fluid removes all of the adhering finely divided solid materials from the particulate solids 8 within the electrofilter. Preferably, this dielectric fluid is a liquid hydrocarbon such as the solvent employed in the extractor/mixer 1 which can be obtained in a relatively pure form from the separator 19. The resultant mixture of solvent and removed oilseeds and finely divided solid material passes from the outlet 16 into 23 and is sent to a suitable system for recovery of the solvent and disposal of the solid material.

If desired, a suitable other dielectric fluid which does not contaminate the solvent or injure the operation of the electrofilter may be employed. Thus, there is a choice in the present process in removing the finely divided solid material from the particulate solids 8 of the electrofilter by the use of the solvent of the miscella or a dielectric fluid.

If desired, for the purposes of cleaning the particulate solids 8, a portion of the miscella oilseed mixture from the extractor/mixer 1 may be employed. The miscella oilseed mixture is passed into the electrofilter at a suitable rate to remove the finely divided solid material from the particulate solids 8 of the electrofilter.

In cleaning, irrespective of the use of solvent, miscella or dielectric fluid, the outlet 16 contains the dielectric fluid carrying oilseeds and other solids. This stream is then passed through 23 to a suitable system wherein the fluid is separated, at least in the majority, from the solid material, for example, by a recovery system which may be the hydroclone or the leaf filter (not shown). Preferably, the hydroclone and leaf filter are used in tandum for optimum removal of the finely divided solid material from the dielectric fluid. The electrofilter can be used as a final cleanup of the dielectric fluid employed in regeneration. The underflow from the hydroclone contains a large content of solid material, and may contain as high as 80 percent of solids by weight. This concentration of mass of solid material and dielectric fluid is passed to the mechanical filtration, such as the leaf filter. A mechanical separation provides a clean dielectric fluid removed and returned into the electrofilter wherein any remaining solids can be removed as was described by the overflow from the hydroclone.

Alternatively, the dielectric fluid effluent from the leaf filter can be diverted into a solvent recovery line wherein the dielectric fluid can be recovered. The actual recovery of the solvent or dielectric fluid depends on the amount of the solid material remaining in it. For example, the dielectric fluid from the hydroclone in the overflow, or in the outlet of the leaf filter, can be returned directly to the mixer/extractor 1 to form a part of the solvent used in extracting the crushed oilseed feed.

Depending upon the type operation desired in the removal of the solid material carried in dielectric fluid or solvent used to clean the electrofilter, the hydroclone and leaf filter may be used individually or in any combination by appropriate systems.

It will be apparent that there has been provided a process well adapted for purifying oil removed from crushed oilseeds by the miscella procedure. The present process is completely compatible with conventional operations in the food industry or other places where oil is recovered from oilseeds and subsequently refined. Of special advantage is the intimate combination and cooperation in the use of an electrofilter in purification of miscella to remove finely dispersed solid materials and also in the periodic cleaning of the electrofilter of trapped finely divided solid material. It is to be understood that certain features and operations of the present process may be employed without departing from the spirit of this invention. This variation is contemplated by, and is within, the scope of the appended claims. It is intended that the foregoing description is to be taken as an illustration of the present invention.

I claim:

1. A process of extracting oil from oilseeds which comprises intimately contacting oil seeds with a dielectric solvent for the oil, thus forming a miscella-oilseed mixture, and electrofiltering said miscella-oilseed mixture.

2. The process of claim 1 where the oilseeds positioned in the electrofilter are further extracted with dielectric solvent.

3. The process of claim 2 where the electrofilter is periodically deactivated and solids adhering to the electrofilter are removed therefrom by flushing with a dielectric fluid.

4. The process of claim 2 where each dielectric solvent is a hydrocarbon liquid.

5. The process of claim 2 where each dielectric solvent is an aliphatic hydrocarbon in the boiling range of 88° F. to 264° F. or mixtures of such aliphatic hydrocarbons.

6. The process of claim 2 where each dielectric solvent is selected from the group consisting of hexane, acetone and cyclohexane.

7. The process of claim 2 where each dielectric solvent is hexane.

8. The process of claim 1 where the electrofilter is periodically deactivated and solids adhering to the electrofilter are removed therefrom by flushing with a dielectric fluid.

9. The process of claim 1 wherein the oilseeds are positioned in the electrofilter during said contacting.

10. The process of claim 9 where the electrofilter is periodically deactivated and solids adhering to the electrofilter are removed therefrom by flushing with a dielectric fluid.

11. The process of claim 9 where the dielectric solvent is a hydrocarbon liquid.

12. The process of claim 9 where the dielectric solvent is an aliphatic hydrocarbon in the boiling range of 88° F. to 264° F. or mixtures of such aliphatic hydrocarbons.

13. The process of claim 9, where the dielectric solvent is selected from the group consisting of hexane, acetone and cyclohexane.

14. The process of claim 9 where the dielectric solvent is hexane.

15. The process which comprises in sequence:

(a) loading the bed of an electrically activated electrofilter with oilseeds from a miscella-oilseed mixture, said oilseeds having adhering miscella, (b) flushing the loaded bed with a dielectric solvent for the oil so as to remove the miscella and additional oil from the oilseed solids, (c) electrically deactivating the electrofilter bed, and (d) removing deoiled solids from the electrofilter bed by flushing with a dielectric fluid.

16. The process of claim 15 wherein the dielectric fluid in step (b) is a hydrocarbon liquid.

17. The process of claim 15 wherein the dielectric fluid in step (b) is an aliphatic hydrocarbon in the boiling range of 88° F. to 264° F. or mixtures of such aliphatic hydrocarbons.

18. The process of claim 15 wherein the dielectric fluid in step (b) is selected from the group consisting of hexane, acetone and cyclohexane.

19. The process of claim 15 wherein the dielectric fluid in step (b) is hexane.

* * * * *